United States Patent [19]

McIlrath

[11] 4,320,707

[45] Mar. 23, 1982

[54] CLIP-APPLYING MACHINE

[75] Inventor: William P. McIlrath, Racine, Wis.

[73] Assignee: Racine Railroad Products, Inc., Racine, Wis.

[21] Appl. No.: 121,594

[22] Filed: Feb. 14, 1980

Related U.S. Application Data

[63] Continuation-in-part of Ser. No. 951,576, Oct. 16, 1978, abandoned.

[51] Int. Cl.[3] ..... E01B 29/32

[52] U.S. Cl. ..... 104/1 R; 91/356; 104/17A; 227/2; 227/5

[58] Field of Search ..... 104/1 R, 2, 12, 17 R, 104/17 A; 227/2, 5; 91/355, 356, 388

[56] References Cited

U.S. PATENT DOCUMENTS

| | | | |
|---|---|---|---|
| 3,096,724 | 7/1963 | Kershaw | 104/12 |
| 3,117,530 | 1/1964 | Miller | 104/17 A X |
| 3,117,531 | 1/1964 | Miller | 104/17 A X |
| 3,177,813 | 4/1965 | Stewart | 104/12 |
| 3,841,221 | 10/1974 | Dieringer et al. | 104/17 A |
| 4,068,593 | 1/1978 | Leeves | 104/1 R |

FOREIGN PATENT DOCUMENTS

| | | | |
|---|---|---|---|
| 408779 | 7/1974 | U.S.S.R. | 227/2 |

*Primary Examiner*—Randolph A. Reese

*Attorney, Agent, or Firm*—Wegner, Stellman, McCord, Wood & Dalton

[57] ABSTRACT

A machine for applying a clip to a tie at a side of a rail and detecting when the clip has been fully seated comprising, a head positionable at a predetermined location relative to the tie and rail, a pair of arms pivotally mounted on the head for rotation in a plane which extends parallel to the rail, and power structure for simultaneously pivoting both of the arms between a raised retracted position and a lowered position. Movement between the retracted and lowered positions causes a clip-engaging member on one arm of the pair to engage and advance the clip to a fully-seated position. The second arm of the pair detects when the clip has reached the fully seated position and stops further movement of the clip-engaging member.

10 Claims, 8 Drawing Figures

190
150

222'
226'
178'
210'
192
130
224
212
220'
196'
194
206
131
216
208'
204
220
208
178
200
206'
198
210
216'
228
226
222
214
151
202

CLIP-APPLYING MACHINE

RELATED APPLICATION

This application is a continuation-in-part of application Ser. No. 951,576 filed Oct. 16, 1978, now abandoned.

BACKGROUND OF THE INVENTION

This invention pertains to a machine for applying a clip to a socket imbedded within a tie and positioned at a side of a rail.

For many years, United States railroads have utilized rails mounted on wooden ties, with rail anchors associated with the rail where needed and with the rail anchors being mounted to extend transverse to the length of the rail and being set and applied by movement and forces applied transverse to the length of the rail. Additionally, tie plates have been positioned between the wooden tie and the rail and with spikes driven into the tie to secure the rail and tie plate to the tie.

In Canada, concrete ties are used wherein clips are associated with sockets cast into the concrete tie and are positioned to overlie the flanges of the rail base to hold the rail and tie in association. Normally, a pair of clips is associated with each rail at either side thereof and at one tie, with the clips being manually set and then forcefully applied, previously by use of a sledge hammer.

Machines, such as that described in U.S. Pat. No. 4,068,593, issued Jan. 17, 1978 to Leeves, have been developed which have the capability of applying either a single clip to one side of the rail or simultaneously applying clips to both sides of a single rail.

However, these machines have not provided any means for determining when the clip is properly driven and fully seated. The Leeves machine, for example, has a clip driving arm which includes an extension that interacts with the socket to stop the arm at a predetermined point, but this does not guarantee that the clip will not be overdriven due to manufacturing differences between sockets or clips.

SUMMARY OF THE INVENTION

A primary feature of the invention disclosed herein is to provide a clip-applying machine which will apply a clip to a socket associated with a tie, sense when the clip has been fully seated and a predetermined applying force has been reached with respect to the clip and terminates the applying force.

In carrying out the foregoing, the machine has a head positionable at a predetermined location relative to a tie and a rail and has a pair of arms pivotally mounted on the head for rotation in a plane which extends parallel to and is located beside the rail. Means are provided on one arm of the pair for engaging and advancing a clip to a fully seated position. The second arm of the pair includes means for sensing when the clip has been fully seated and driven with a predetermined force. When this predetermined force has been reached, further movement of the clip advancing arm is arrested. Means on the head provide for pivoting of the arms between a raised, retracted position and a lowered position, with movement between said positions causing the clip-engaging means to engage a clip and advance it to a fully seated position.

More specifically, the head is carried by a wheeled frame movable along a pair of rails and the head has two pivot mountings at the lower end extending toward a side of the rail. One pivot mounts one of the clip-applying arms. A fluid cylinder is connected to this arm and is connected in a fluid circuit to cause movement of the arm to apply a clip by rotation of the arm in its plane. The remaining pivot mounts a second arm positioned to intercept the clip when it nears its fully driven position. A fluid circuit senses when a predetermined force has been applied to the clip and operates to arrest any further movement of the clip-applying arm.

The head may additionally be provided with a second pair of arms on the opposite side of the rail to simultaneously drive a second clip and an identical arrangement may be associated with the remaining rail to simultaneously drive four clips.

DESCRIPTION OF THE PREFERRED EMBODIMDENT

Figure 1:
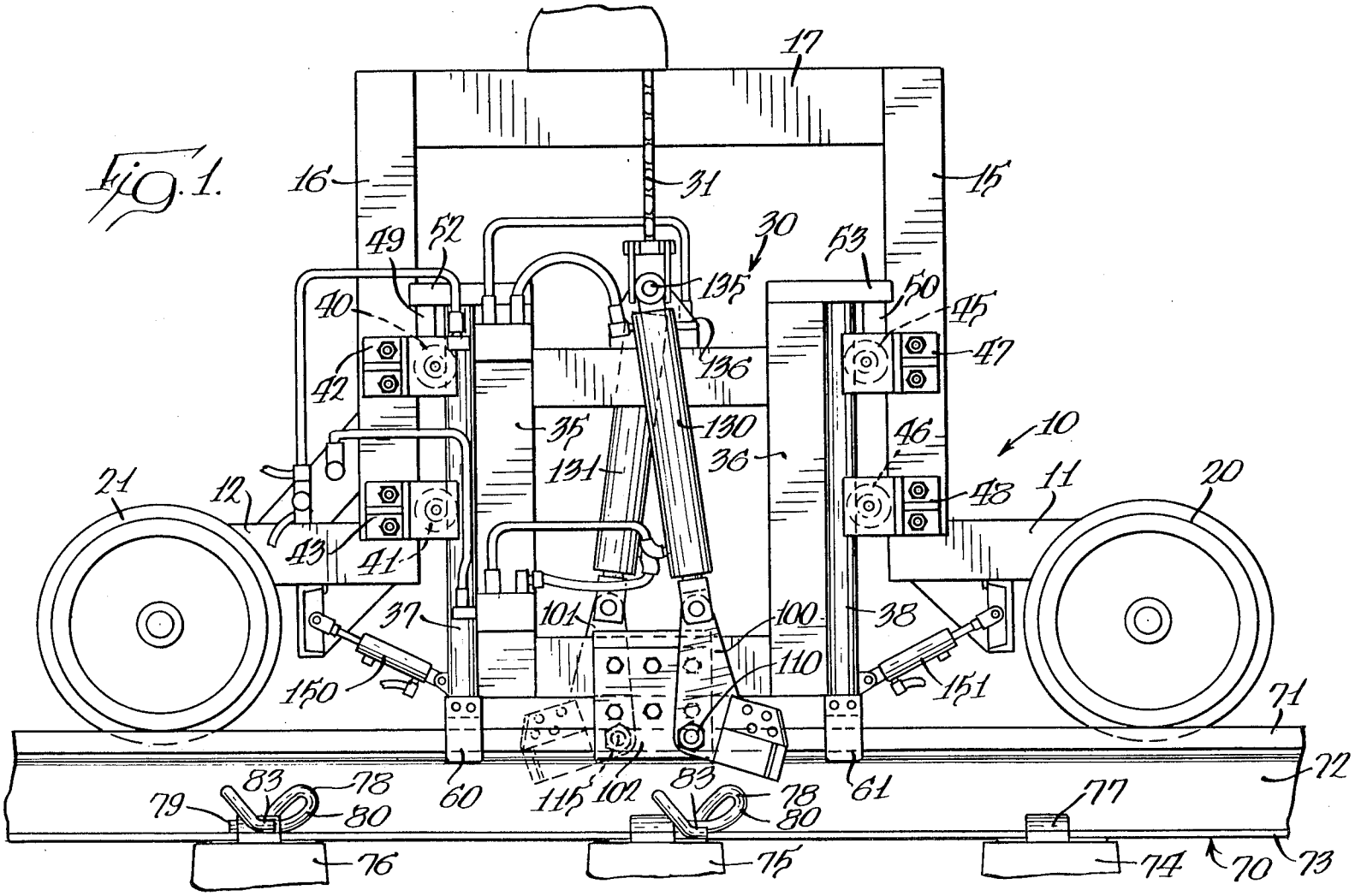
FIG. 1 is a fragmentary side elevational view of the clip-applying machine associated with a railroad track including a rail supported on a plurality of ties.

A wheeled frame is indicated generally at 10 in FIG. 1 and may be of a type generally known in the art for supporting track maintenance structure. The frame has base members 11 and 12 interconnected by an upper structure, including upright members 15 and 16 and a horizontal connecting member 17 and with comparable structure being laterally spaced therefrom. The base members 11 and 12 each support a rail-engaging wheel 20 and 21, respectively, and with the laterally spaced base members supporting an additional front and rear wheel whereby the frame may move along the rail. The wheels may be driven by power means (not shown).

A head, indicated generally at 30, is vertically movable relative to the frame, with the elevation thereof being controlled by a movable chain member 31 connected to the head and with the vertical movement being guided by guide structure connected between the head and frame. The head 30 has a pair of interconnected, spaced-apart members 35 and 36 which extend vertically and with each of these members having an elongate vertical generally round guide tube 37 and 38, respectively, which coact with guide members carried by the wheeled frame. The guide tube 37 coacts with a pair of vertically-spaced, conical guide rollers 40 and 41 carried by brackets 42 and 43 secured to the frame member 16. The guide tube 38 coacts with a pair of conical guide rollers 45 and 46 carried by brackets 47 and 48, respectively, on the frame member 15. With this structure, the head 30 is free to move up and down relative to the vehicle frame under the control of the chain 31.

Figure 4:
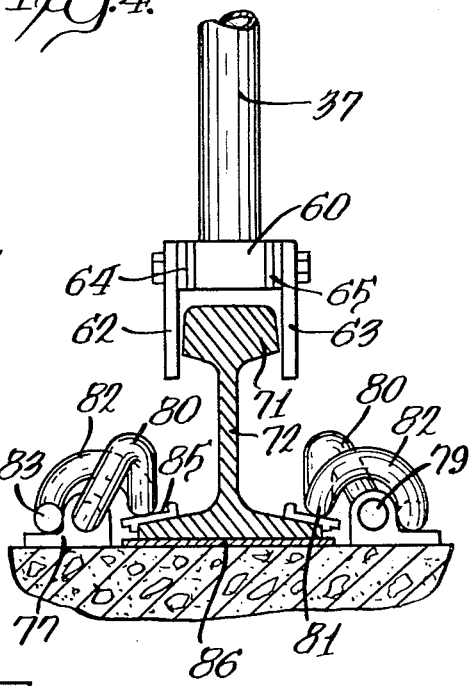
FIG. 4 is a fragmentary vertical section, taken generally along the line 4–4 in FIG. 2.

The lowered position of the head is established by a pair of spacer blocks 49 and 50 which may be selected of a suitable size to locate the head relative to a rail and which are mounted on the brackets 42 and 47, respectively, to underlie a lateral extension from each of the head members 35 and 36 and as identified at 52 and 53, respectively. Guide means 60 and 61 are located at the lower end of the head and act to prevent sway of the head during operation of the machine. One of these guide means is shown particularly in FIG. 4 and has a pair of depending side plates 62 and 63 which can have their spacing varied by the use of shims 64 and 65 to have the spacing between the plates roughly equal to the width of the rail ball 71.

Figure 3:
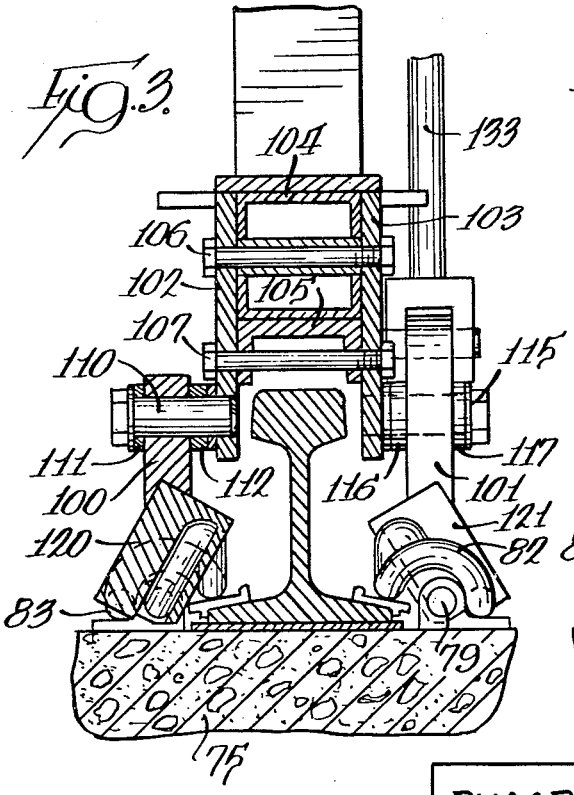
FIG. 3 is a fragmentary vertical section, taken generally along the line 3—3 of FIG. 2.

Referring to FIG. 1, the machine is shown associated with a rail 70 having a ball 71, a web 72 and a base 73. The rail is shown as overlying three ties 74, 75 and 76. Each of the ties has four sockets 77 imbedded therein and each socket has an opening extending lengthwise thereof. Two of the sockets lie at opposite sides of one rail and two at opposite sides of the other rail. A clip 78 is shown set in association with a socket of the tie 75 and another clip is shown fully seated in association with a socket carried by the tie 76. The clip has a first leg 79 which fits within the longitudinal opening of the socket and which is connected by a curved section 80 to a hold-down section 81 and with a second curved section 82 connecting the hold-down section 81 to a second leg 83. As shown particularly in FIGS. 3 and 4, the hold-down section 81 firmly engages an insulator pad 85 supported on the upper surface of the rail base flange and the second leg 83 firmly engages a part of the socket 77 whereby the rail is firmly held against the tie with a tie pad 86 positioned therebetween.

Figure 2:
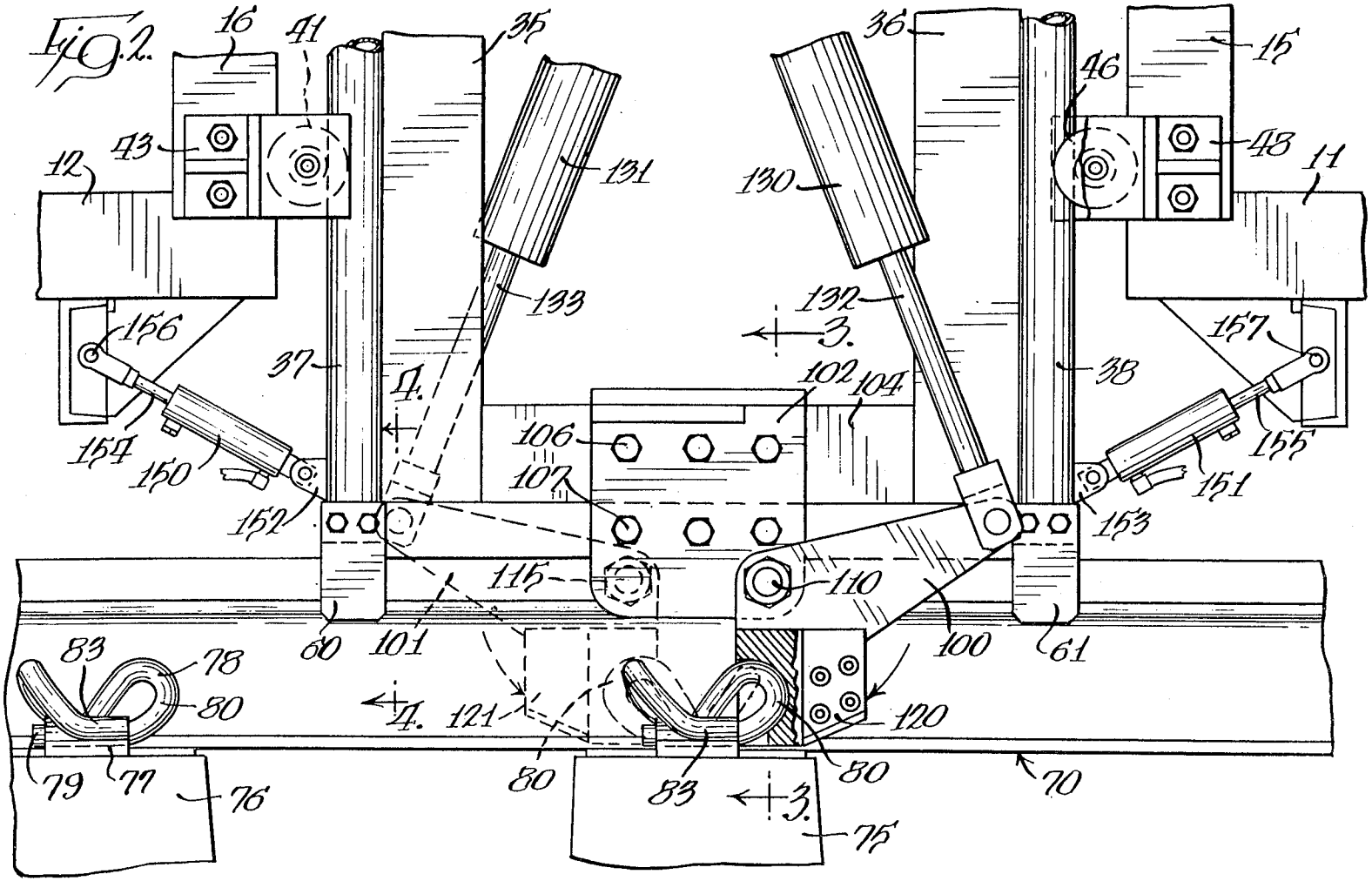
FIG. 2 is a fragmentary view, on an enlarged scale, of the central part of the structure shown in FIG. 1 and with the clip-applying arms shown in fully lowered position.

With the clip set in the position shown in FIG. 1 in association with the tie 75, the head 30 has an applying arm 100 movable between the raised position of FIG. 1 and the lowered position, shown in FIG. 2, to apply the clip and move the clip to a fully-seated position and as shown in FIG. 2. The arm 100 moves in a plane which is parallel to and at one side of the rail 70 while a second arm 101 moves in a parallel plane and at a side of the rail opposite to the side where the arm 100 operates. The arms 100 and 101 are supported at the lower end of the head 30 for pivoting movement by a frame structure including a pair of plates 102 and 103 which lie to either side of a box channel member 104 forming part of the head frame and a strengthening beam 105 disposed therebeneath, with this structure held together by a series of bolts 106 and 107. The lower end of the plate 102 mounts a fixed shaft 110 which rotatably mounts the arm 100 with spacers 111 and 112 positioned to either side of the arm. The plate 103 mounts a fixed shaft 115 for pivotally mounting the arm 101 and with similar spacers 116 and 117 associated with the shaft and the arm.

Each of the arms has a clip-engaging means associated therewith and, as shown for arm 100, the clip-engaging means includes a member 120 formed of interconnected, shaped members which receive the curved section 80 of the clip and also which abut against the second leg 83 of the clip (FIG. 3) to firmly hold the clip as pressure is exerted on the clip to move the first leg 79 thereof into a fully-seated position in the socket 77. A similar clip-engaging structure 121 is carried at the lower end of the arm 101.

Fluid power means for causing movement of the arms 100 and 101 comprises a pair of hydraulic cylinders 130 and 131 having their respective piston rods 132 and 133 connected to the arms 100 and 101, respectively. The upper ends of the cylinders are pivoted at 136 to a bracket 136 carried on the head 30. A hydraulic circuit for causing operation of the cylinders 130 and 131 is shown schematically in FIG. 5 wherein a pump 140 supplied hydraulic fluid under pressure to a control valve 141 and with the valve having positions including a first position to connect a line 142 to fluid pressure and a line 143 to reservoir 144 and a second position to reverse the connections. The line 142 connects to a pair of lines 145 and 146 leading to the upper ends of the cylinders 130 and 131. When pressure fluid is supplied to the line 142, the piston rods 132 and 133 of the cylinders are caused to extend to move the anchor-applying arms 100 and 101 from the upper position shown in FIG. 1 to the lowered position, shown in FIG. 2. Shift of the valve 141 to the second position causes slow delivery of pressure fluid through line 143 which connects to lines 147 and 148 which deliver pressure fluid to the opposite ends of the cylinders and cause retraction of the piston rods 132 and 133 to raise the anchor-applying arms. The line 143 has an orificed check valve 149 which permits free flow to reservoir 144 while restricting pressure flow to limit the rate of upward movement of arms 100 and 101.

Figure 5:
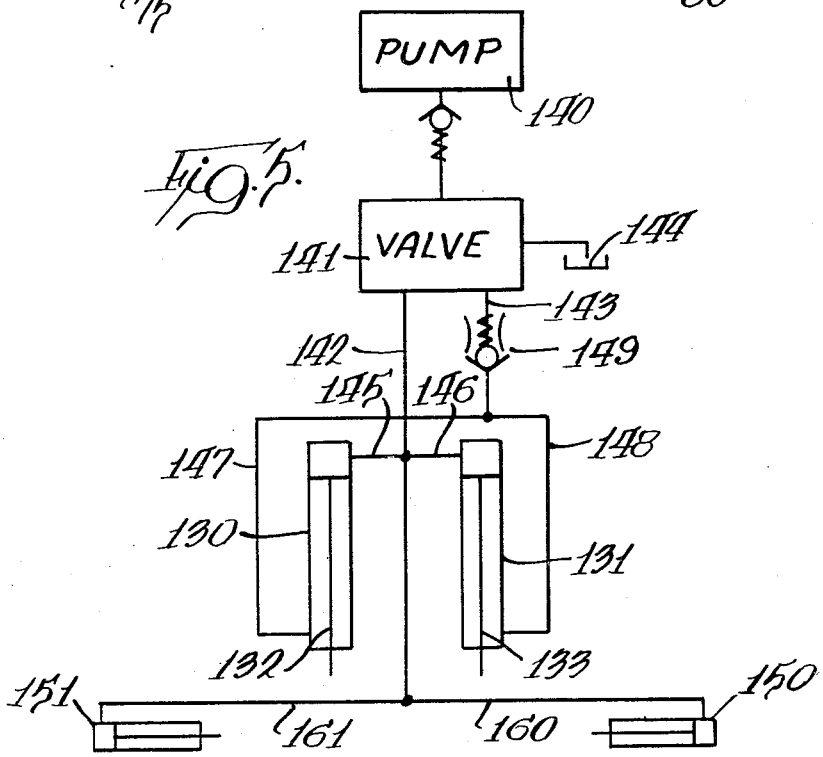
FIG. 5 is a schematic circuit drawing of the fluid circit for the machine shown in FIGS. 1–4.

During the push against a pair of clips 78 at opposite sides of a rail by movement of the two anchor-applying arms in opposite directions, there is a balance of opposing forces acting horizontally along the rails. However, there is an upward force tending to raise the head 30. This force is counteracted by a pair of single-acting cylinders 150 and 151 which are connected between brackets 152 and 153, respectively, fastened to the lower end of the head and have their piston rods 154 and 155 pivotally connected to the vehicle frame, as indicated at 156 and 157. As shown in FIG. 5, the single-acting cylinders 150 and 151 are connected in parallel with the main cylinders 130 and 131 by a pair of lines 160 and 161 which connect to the line 142.

In operation of the clip-applying machine, the vehicle frame is moved to a position as shown in FIG. 1 with the anchor-applying arms in raised position and overlying a pair of clips 78 which have been initially set in position. The valve 141 is then operated to move the anchor-applying arms to the position shown in FIG. 2 wherein the pair of clips are applied and the cylinders 150 and 151 actuated to immobilize the head 30 with respect to the frame 10. The combined weight of the head 30 and frame 10 thereby acts to counteract the vertical resultant force generated during the clip-applying operation.

Figure 6:
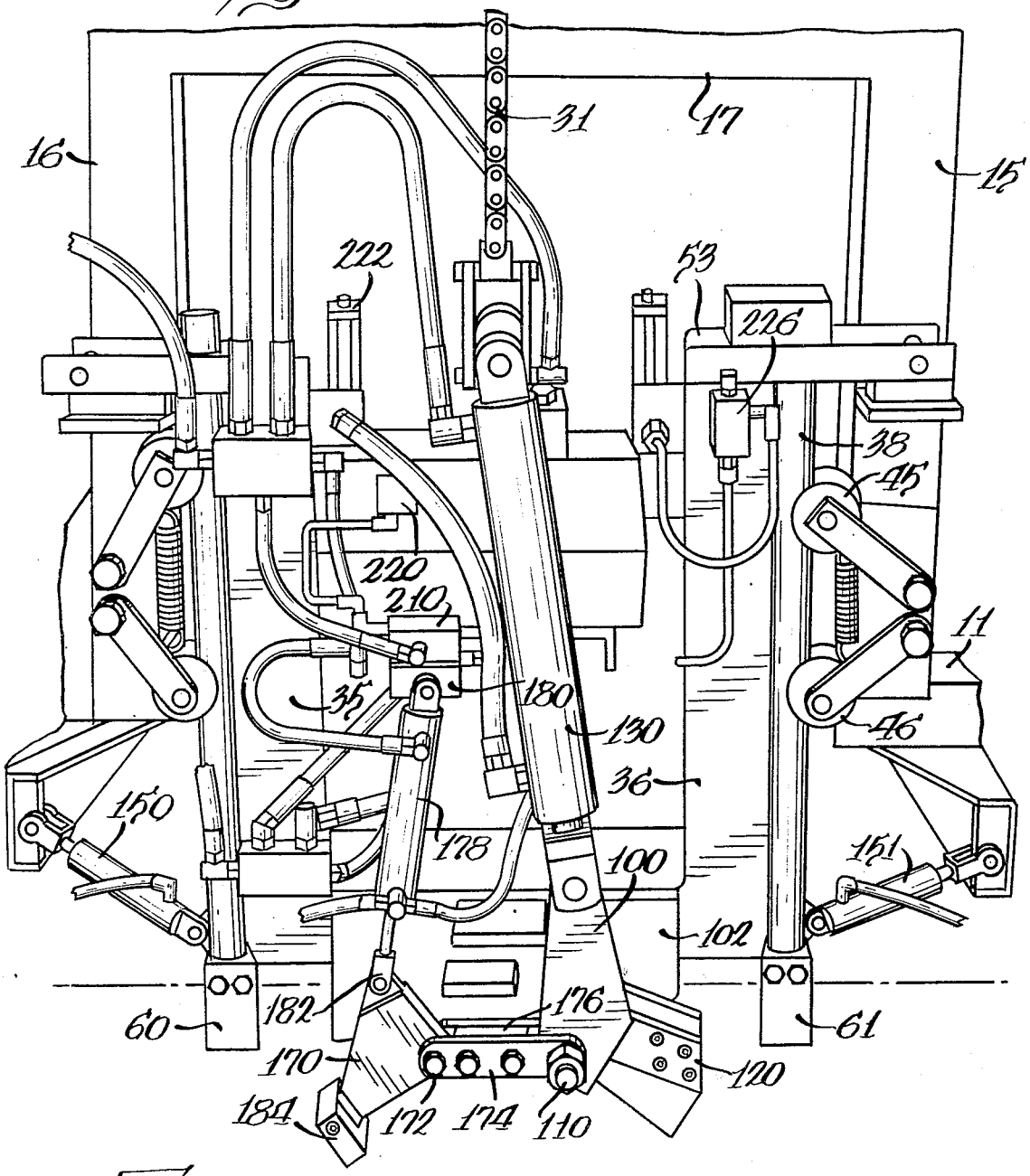
FIG. 6 is a fragmentary view, on an enlarged scale, of the central part of the structure shown in FIG. 1 including the clip position sensing arm and fluid circuit.

FIG. 6 illustrates a machine which operates identically to the machine shown in FIGS. 1–5, with the exception that clip sensing apparatus has been incorporated to determine when the clip 78 has been correctly applied and prevent the clip-applying arms 100 and 101 from overdriving the clips 78.

Figure 7:
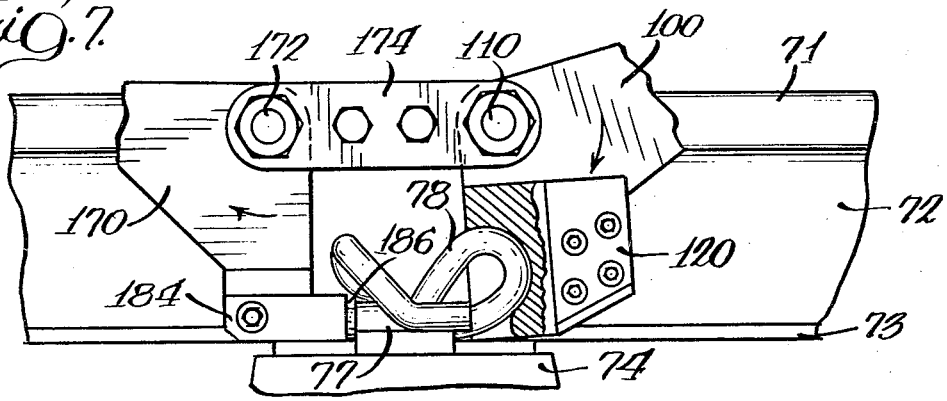
FIG. 7 is an enlarged fragmentary view of the structure shown in FIG. 6 with the clip applying and sensing arms shown in fully lowered positions.

The machine illustrated in FIG. 6 includes a pivotally mounted sensing arm 170 movable between a raised position shown in FIG. 6 and a lowered position adjacent the socket 77, as shown in FIG. 7. The arm 170 is mounted on a shaft 172 which extends from the plate 102 parallel to the clip-applying arm shaft 110. The shafts 110 and 172 are interconnected for reinforcement by a connecting link 174 bolted to the plate 102 through a spacer block 176.

The sensing arm 170 is raised and lowered by means of a hydraulic sensing cylinder 178 which is pivotally connected at its upper end to a bracket 180 attached to the head 30, and to the arm 170 by a clevis 182. The lower end of the stop arm 170 terminates in a transversely widened stop block 184 which extends toward and spans the socket 77.

The stroke of the cylinder 178 is chosen such that at full stroke a face 186 of the stop block 184 will stop parallel and adjacent to the socket 77.

While not shown for clarity of the drawings, a second arm moves in a parallel plane and at a side of the rail opposite to the side where the sensing arm 170 operates. This second arm bears the same relationship to the clip-applying arm 101 that sensing arm 170 bears to the clip-applying arm 100.

Figure 8:
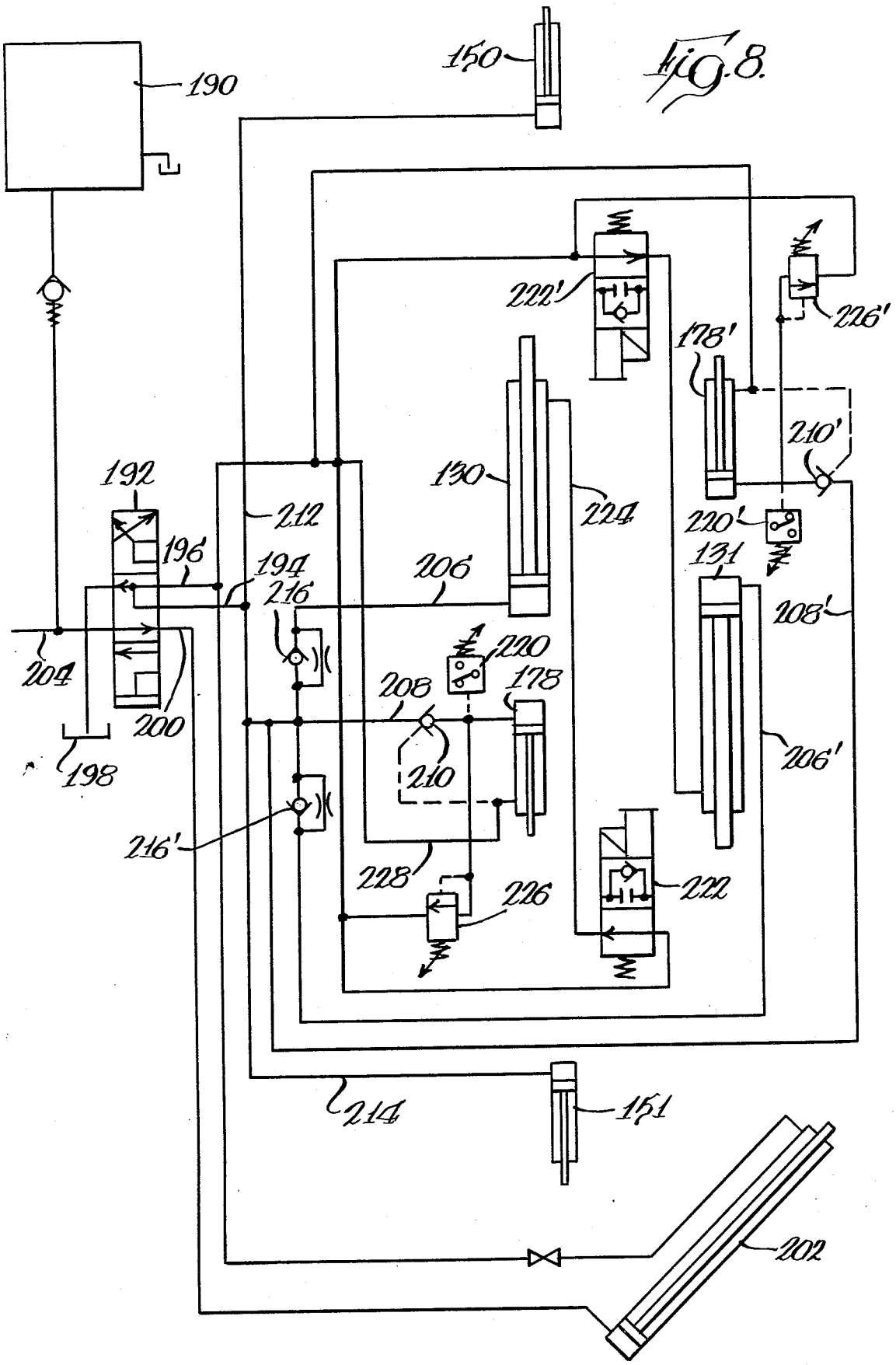
FIG. 8 is a schematic circuit drawing of the fluid circuit for the machine shown in FIG. 6.

A hydraulic circuit for causing operation of the clip-applying cylinder 130, the sensing cylinder 178, and the head/frame connecting cylinders 150 and 151 is shown schematically in FIG. 8 wherein a pump 190 supplies hydraulic fluid under pressure to a control valve 192. The valve 192 has positions which include a first position to connect a line 194 to fluid pressure and a line 196 to a reservoir 198 and a third position to reverse these connections. An intermediate second position and an auxiliary line 200 are also provided to control a cylinder 202 used to adjust the vertical height of the head 30 through the chain 31.

While FIG. 8 represents the hydraulic circuitry associated with clip-applying apparatus located on both sides of a single rail, only the operation of structure located on one side of the rail will be described, it being understood that apparatus on the opposite side, identified by similar numbers including a prime (′), operates identically. Also, the pump 190 supplies pressure to a line 204 which leads to a valve and circuitry associated with apparatus located on both sides of the second rail. This circuitry is not shown since it operates identically to the circuitry shown in FIG. 8.

The line 194 connects to a line 206 leading to the upper end of a fluid motor 130 in the form of a cylinder, a line 208 leading to the upper end of the cylinder 178 through a pilot check valve 210, and lines 212 and 214 which connect to the head/frame cylinders 150 and 151.

When the pressure fluid is supplied to line 194, the piston rod of the sensing cylinder 178 extends radially to move the stop block 184 adjacent the socket 77 and the cylinders 150 and 151 are actuated to rigidly connect the head 30 and the frame 10 as described above. Simultaneously, fluid pressure is provided to the upper end of the clip-applying cylinder 130 to move the applying head 120 toward the clip 78. Fluid flow to the cylinder 130 is limited by a check valve and orifice combination 216 to ensure that the block 184 and the frame/head cylinders 150 and 151 are fully actuated before force is applied to the clip 78.

As the clip 78 is pushed through the socket 77, its first leg 79 will contact the face 186 of the stop block 184 and begin to cause the stop arm 170 to rotate toward the retracted position. Very slight movement of the arm 170 will cause fluid pressure within the upper end of cylinder 178 to increase since fluid within this cylinder is isolated from the circuit by the check valve 210. This pressure build-up activates a pressure switch 220 connected into line 208 producing an electrical signal which in turn causes a solenoid operated valve 222 to move from a normally open position, shown in FIG. 8, to a closed position. The closed position prevents fluid flow from the lower side of the cylinder 130 by blocking a line 224 to the tank 198, thereby preventing any further movement of the clip-applying piston rod 132 and shoe 120. A pressure relief valve 226 is connected to the upper end of the cylinder 178 to prevent excessive pressure build-up within the cylinder.

When the connections to the lines 194 and 196 are reversed, the single acting head/frame cylinders 150 and 151, the upper end of the cylinder 178, and the upper end of the clip-applying cylinder 130 are all relieved to the tank 198 and fluid pressure is provided to the lower ends of the cylinders 178 and 130 through lines 224 and 228. The sensing cylinder 178 is no longer isolated from the circuit since reverse pressure opens the check valve 210. The arms 170 and 100 will thus be returned to the position shown in FIG. 6, ready for movement to the next clip and another operation.

It will be understood that the machine may have sets of clip-applying 130 and sensing 178 cylinders on either side of each rail whereby four clips may be applied and positioned at the same time.

If the machine is to be operated with different height rails, different height spacer blocks 49 and 50 may be used to control the elevation of the head 30. If the ball 71 of the rail 70 has a different width, the shims associated with the guide plates 62 and 63 may be changed.

Although the machine has been disclosed in connection with applying clips to concrete ties, it will be obvious that the machine can be used in applying clips to wood ties. In such instance, the pivot shafts 110 and 172 for the anchor-applying arms and position sensing arms would be positioned at an increased distance apart because of a longer slot or channel to receive the clip leg.

I claim:

1. A machine for applying a clip to a tie alongside a rail and detecting when said clip is fully seated comprising:

a pair of arms pivotally mounted for rotation in a plane which extends parallel to said rail, means on one of said arms for engaging and advancing said clip to a fully seated position, and means associated with the other of said arms for engagement by said clip for detecting the fully-seated clip position, said detecting means including hydraulic circuit means having a hydraulic cylinder connected to said other arm, means for isolating fluid within said cylinder, and means for sensing a fluid pressure rise within said cylinder in response to predetermined movement of said clip and providing a signal when said pressure reaches a predetermined magnitude.

2. The machine defined in claim 1 wherein said fluid isolating means includes check valve means for selectively preventing fluid from escaping said cylinder.

3. The machine defined in claim 1 wherein said signal means includes pressure responsive switch means for sensing a fluid pressure rise within said cylinder.

4. The machine defined in claim 3 including means for arresting advancement of said one arm in response to said signal.

5. The machine defined in claim 4 wherein said advancing means is a hydraulic motor connected to said one arm and said arresting means is valve means for terminating fluid flow within said motor.

6. The machine defined in claim 3 wherein said switch means is a pressure responsive electrical switch which provides an electrical signal when a predetermined pressure within said cylinder is exceeded.

7. The machine defined in claim 6 including means for stopping said one arm in response to said electrical signal.

8. The machine defined in claim 7 wherein said advancing means is a hydraulic motor connected to said one arm and said stopping means is an electrically controlled valve means.

9. The machine defined in claim 8 wherein said valve means is a solenoid operated hydraulic valve which prevents fluid flow within said motor in response to said electrical signal.

10. A clip-applying machine for applying a clip to a tie to secure a rail thereto and detecting when said clip has been fully seated comprising:

first and second arms pivotally mounted beside a rail in a plane extending parallel to said rail for rotation in opposite directions between a raised retracted position and a lowered position wherein said first arm engages said clip and said second arm is engaged by said clip;

a fluid motor connected to said first arm for causing rotation of said arm between said positions;

a hydraulic sensing cylinder connected to said second arm for causing rotation of said arm between said positions and detecting movement of said second arm in response to engagement by and movement of said clip;

a hydraulic circuit interconnecting said motor and said sensing cylinder for providing fluid to said motor and cylinder, sensing application of a predetermined force to said clip by said first arm in response to movement of said clip, and arresting rotation of said first arm when said clip is fully seated, having:

a fluid source;

means located between said source and said cylinder for selectively isolating fluid within said sensing cylinder including a pilot operated check valve;

means connected to said cylinder for sensing a fluid pressure within said cylinder in response to movement of said clip and providing a signal when said pressure exceeds a predetermined magnitude including a pressure responsive electrical switch which provides an electrical signal when said predetermined pressure is exceeded;

means connected to said motor responsive to said signal for terminating fluid flow within said motor thereby stopping movement of said first arm including a solenoid actuated hydraulic valve having a first position permitting fluid flow from said motor and a second position blocking fluid flow from said motor, said valve shifting from said first to second positions in response to said electrical signal.

* * * * *